US007592968B2

(12) United States Patent
Modro

(10) Patent No.: US 7,592,968 B2
(45) Date of Patent: Sep. 22, 2009

(54) EMBEDDED ANTENNA

(75) Inventor: Joseph Modro, Dublin (IE)

(73) Assignee: TDK Corporation, Tokyo (JP)

( * ) Notice: Subject to any disclaimer, the term of this patent is extended or adjusted under 35 U.S.C. 154(b) by 369 days.

(21) Appl. No.: 11/386,851

(22) Filed: Mar. 23, 2006

(65) Prior Publication Data

US 2007/0222699 A1 Sep. 27, 2007

(51) Int. Cl.
*H01Q 1/40* (2006.01)

(52) U.S. Cl. ..... 343/873

(58) Field of Classification Search ..... 343/873, 343/700 MS, 702, 876, 895, 820
See application file for complete search history.

(56) References Cited

U.S. PATENT DOCUMENTS 7,369,086 B2 * 5/2008 Luen ..... 343/700 MS
2004/0113848 A1 * 6/2004 Gaucher et al. ..... 343/702
2005/0248488 A1 11/2005 Modro
2006/0017620 A1 * 1/2006 Chen et al. ..... 343/700 MS
2006/0214855 A1 * 9/2006 Harada et al. ..... 343/700 MS
2007/0164905 A1 * 7/2007 Lempkowski et al. . 343/700 MS
2007/0176832 A1 * 8/2007 Qian et al. ..... 343/702
2007/0176843 A1 * 8/2007 Qureshi et al. ..... 343/700 MS
2008/0074333 A1 * 3/2008 Seo ..... 343/702

* cited by examiner

*Primary Examiner*—Huedung Mancuso
(74) *Attorney, Agent, or Firm*—Oliff & Berridge, PLC

(57) ABSTRACT

An antenna comprising a resonant structure having a first portion disposed in a first plane, and a second portion disposed in a non-parallel plane. The resonant structure is embedded in a non-conductive or dielectric material and the second portion is formed from electrically conductive vias.

16 Claims, 2 Drawing Sheets

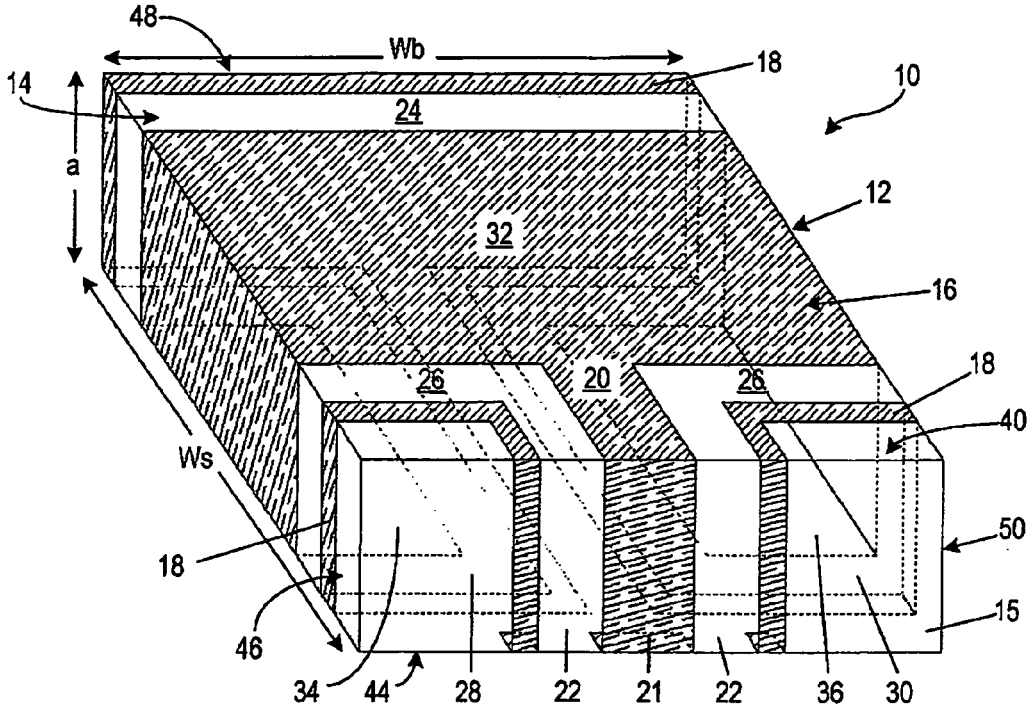
FIG. 1 - PRIOR ART
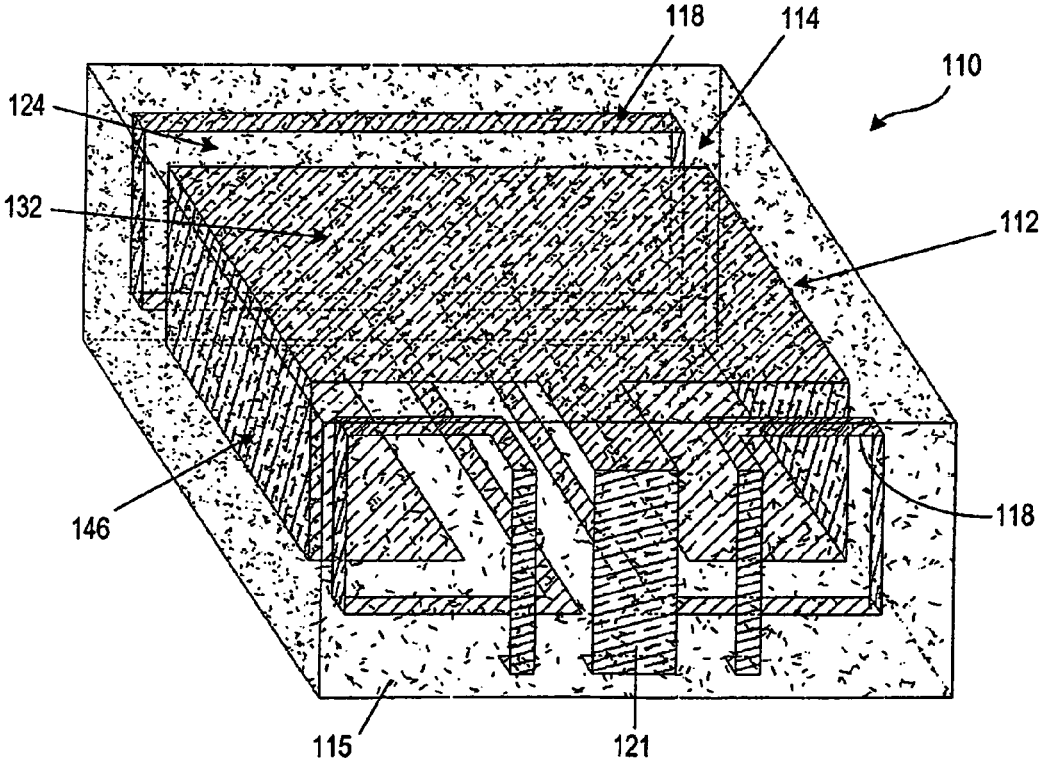
FIG. 2

EMBEDDED ANTENNA

FIELD OF THE INVENTION

The invention relates to antennas, especially, but not exclusively, electrically small planar antennas for use in portable wireless devices such as mobile (cellular) telephones, personal digital assistants (PDAs) and audio-visual entertainment devices.

BACKGROUND TO THE INVENTION

There is a general trend towards miniaturisation of portable electronic devices, including portable wireless devices. As a result, antennas compete for space with the other device components (e.g. battery, display, keypad, printed circuit board).

In addition, modern wireless systems demand increasingly greater bandwidths in order to accommodate higher data rates. This is particularly true of video and audio applications that use the Ultra-Wideband (UWB) protocols being standardised by the IEEE. However, the goals of reduced physical size and increased bandwidth are not normally compatible. Further, reducing the physical size of the antenna normally tends to reduce the radiation efficiency of the antenna. There are fundamental theoretical performance compromises for electrically small antennas between required bandwidth, radiation efficiency and physical volume of the near-fields around the antenna (at a given centre frequency). Recent advances in small antenna design have attempted to achieve the highest bandwidth and radiation efficiency for a given volumetric size and operating frequency.

A key challenge in small antenna design is to provide adequate VSWR (voltage standing wave ratio) bandwidth and radiation performance for a given product application and physical volume requirement.

It would be desirable, therefore, to provide an antenna which, physically, is relatively small while satisfying relatively large bandwidth requirements and radiation efficiency requirements.

To this end, United States patent application US2005248488 (Modro), discloses a planar antenna folded to preserve or enhance the near-field resonant modes of the structure. It would be desirable, however, to improve on the antenna of US2005248488.

SUMMARY OF THE INVENTION

Accordingly, a first aspect of the invention provides an antenna comprising a resonant structure having a first portion disposed in a first plane, and at least one second portion disposed in a plane non-parallel with said first plane, wherein the resonant structure is embedded in a non-conductive material, and wherein said at least one second portion comprises at least one electrically conductive via.

Typically, said resonant structure comprises a third portion, the third portion being spaced apart from, and substantially parallel with, said first portion, said at least one second portion being disposed between said first and third portions.

Said at least one second portion may electrically connect said first and third portion and, in typical embodiments, extends between respective edges of said first and third portions.

Conveniently, said second portion is substantially perpendicular with said first portion. Said first portion normally comprises a layer or lamina of electrically conductive material and may for example be substantially rectangular in shape. A respective second portion is typically provided at opposite edges of said first portion. Said third portion may comprise a layer or lamina of electrically conductive material.

The second portion typically comprises at least two vias. The vias may be mutually spaced-apart or contiguous with one another. In preferred embodiments, the vias are arranged in a row and are aligned in a substantially coplanar manner.

In typical embodiments, the resonant structure is embedded in layers of embedding material, said first plane being substantially parallel with said layers and wherein said at least one via passes through at least one layer of embedding material. The embedding material may comprise a multilayer substrate of non-conductive material, for example a dielectric material.

In some embodiments, the first portion comprises a layer or lamina of electrically conductive material and is shaped to define at least one slot, the at least one slot being open-ended at an interface between the first portion and at least one of said at least one second portions, wherein said at least one second portion includes a respective via aligned with a respective edge of said at least one slot, said respective vias defining a gap therebetween that is substantially aligned with the open end of said at least one slot. The gap is preferably substantially the same width as said at least one slot.

A second aspect of the invention provides a method of manufacturing an antenna comprising a resonant structure having a first portion disposed in a first plane, and at least one second portion disposed in a plane non-parallel with said first plane, the method comprising embedding the resonant structure in layers of non-conductive material; forming said at least one second portion by forming at least one electrically conductive via through at least one layer.

The present invention enables the size of antennas to be reduced while utilizing existing well-proven manufacturing technology.

Further advantageous aspects of the invention will be apparent to those ordinarily skilled in the art upon review of the following description of preferred embodiments and with reference to the accompanying drawings.

BRIEF DESCRIPTION OF THE DRAWINGS

Embodiments of the invention are now described by way of example and with reference to the accompanying drawings in which:

FIG. 1 shows, in perspective view, a prior art planar antenna folded around the outer surface of a substrate;

FIG. 2 shows, in perspective view, an antenna embodying the invention, the antenna being embedded in non-conductive or dielectric material;

DETAILED DESCRIPTION OF THE DRAWINGS

Figure 3:
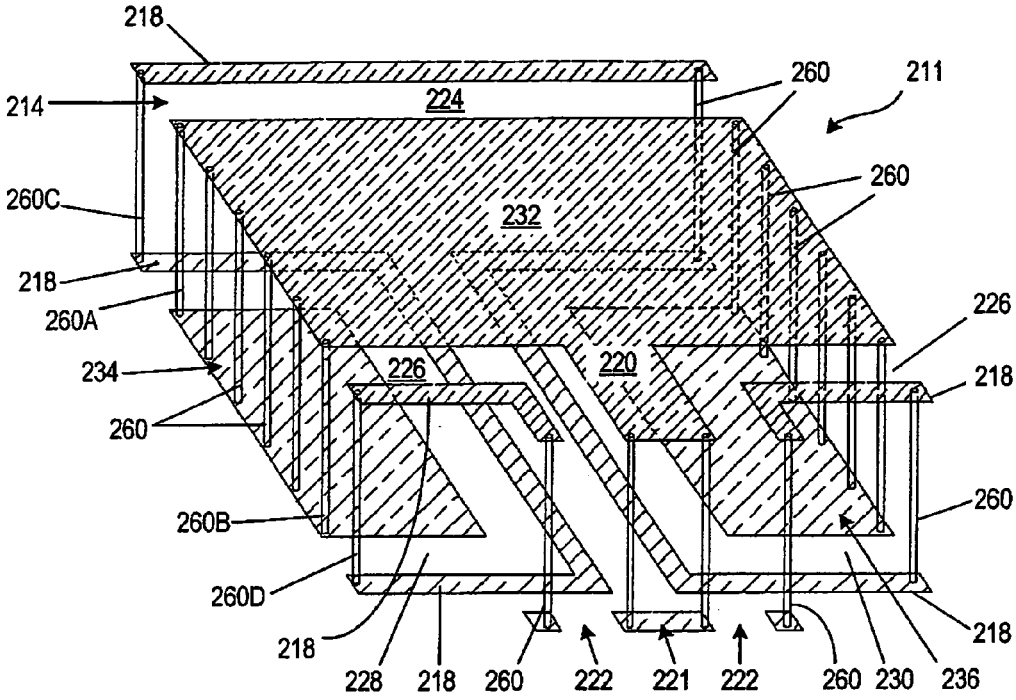
FIG. 3 shows, in perspective view, the conductive components of a preferred antenna embodying the invention.

Referring now to FIG. 1, there is shown a folded, rectangular slot-loop antenna 10 which may be the same or similar to the antenna of FIG. 2 of United States patent US2005248488. The antenna 10 comprises a layer, or lamina, of electrically conductive material 12, typically metal, e.g. copper, provided on a substantially cuboid substrate 15, typically comprising non-conductive or dielectric material. The substrate 15 has a width Wb, a length Ws and a thickness a. The antenna 10 has a substantially rectangular obverse face 40 and a substantially rectangular reverse face 42 joined by four substantially rectangular side faces 44, 46, 48, 50. The obverse face 40 and reverse face 42 are substantially parallel and oppositely disposed with respect to one another, the side faces 44, 46, 48, 50 being substantially perpendicular to the obverse and reverse faces 40, 42. The conductive layer 12 is provided on the substrate layer 15 such that a central region 32 of the conductive layer 12, including a feed portion 20, is located on the obverse face 40, and that end regions 34, 36 of the conductive layer 12 are located partly on opposing side faces 46, 50 and partly on the reverse face 42.

A quantity of the conductive material is removed from layer 12 to define a substantially rectangular loop-shaped slot 14 (which may be referred to as a slot-loop) through which the substrate 15 is exposed. The slot 14 divides the conductive layer 12 into a lamina 16 and a ground plane member 18. The slot 14 substantially surrounds the lamina 16 but is open ended to provide the feed portion 20 of conductive material by which electrical signals (typically electromagnetic signals such as radio frequency (RF) or microwave signals) may be fed to and received from the lamina 16. A coupling device in the form of a conductive feed line 21, for example a coplanar waveguide, is provided for supplying signals to, and/or receiving signals from, the lamina 16 via the feed portion 20. The feed line 21 is electrically isolated from the ground plane 18 by feed line slot portions 22. The lamina 16, ground plane 18 and slot 14 may together be referred to as the resonant structure of the antenna 10.

The slot 14 is generally loop shaped and comprises a first slot portion 24 which is oppositely disposed with respect to the feed portion 20; a second slot portion 26 which is oppositely disposed with respect to the first slot portion 14 and is interrupted by the feed portion 20; and third and fourth slot portions 28, 30 which are oppositely disposed with respect to one another and which join the first and second slot portions 24, 26 at respective ends. In the preferred embodiment, the slot 14 is generally rectangular, the first and second slot portions 24, 26 being generally parallel with one another and the third and fourth slot portions 28, 30 being generally parallel with one another. Hence, the lamina 16 is also generally rectangular.

The slot 14 is folded around the substrate layer 15 so that the portions of the slot 14 which, during fundamental resonance mode, are associated with a significant electric or magnetic field (in particular the electromagnetic near-fields, i.e. the fields that are present adjacent the antenna) are located on the obverse face 40, while the portions of the slot 14 which, during fundamental resonance mode, are associated with negligible or substantially zero electric or magnetic field are located mainly on the reverse face 42.

The close proximity of the end regions 34, 36 and their respective slot portions 28, 30 on the reverse face 42 of the antenna 10 does not cause mutual interference because the slot portions are associated with little or no magnetic current/electric field during use.

The portions of the conductive layer 12 on the side faces 46, 50 of the substrate 15 comprise conductive strips. Depositing conductive material on the sides 46, 50 of the substrate 15 as well as on the obverse and reverse faces 40, 42 complicates the manufacturing process. Moreover, it is found that the electrical and magnetic fields generated around the antenna 10 during use, i.e. the near-fields, are not symmetrical and exhibit irregularities (especially around the slot 14 at the interface between the obverse/reverse faces 40, 42 and the side faces 46, 50) that can adversely affect the performance of the antenna 10. It is important that the electric and magnetic near-fields associated with adjacent portions (e.g. the end regions 34, 36 and their respective slot portions 28, 30) of the resonating structure of the antenna 10 do not appreciably destructively interfere after folding. It is now considered that antenna structures with some degree of symmetry of their near-field distribution (which is often associated with a symmetrical geometry of the antenna) are more amenable to folding in this way.

Accordingly, it is proposed to embed a folded antenna within electrically non-conductive, or insulating, material, e.g. a dielectric material. Advantageously, the non-conductive material also exhibits a relatively high magnetic permeability, for example a magnetic permeability of at least 2.5 and preferably at least 3. The embedding material may be said to comprise high contrast material, or high electromagnetic contrast material. Normally, such material has a dielectric constant or magnetic permeability that is greater than 1 (in a vacuum). The material in which the antenna is embedded (hereinafter referred to as the embedding material) surrounds at least those portions of the antenna that create, or are associated with, electrical and magnetic near-fields during use. In the example of a folded slot-loop antenna the same or similar to the antenna 10 of FIG. 1, the embedding material surrounds at least the slot 14. In practice, it is convenient to embed the whole of the antenna, or at least the whole of the conductive layer together with any slots formed therein, in embedding material. In preferred embodiments, the embedding material covers, or substantially covers, the resonant structure of the antenna. Typically, this includes conductive layer(s) or lamina(s) and any slots formed therein, or any other component that resonates during use when electromagnetic signals are received by or emitted from the antenna. Clearly, one or more connection or feed points are exposed so that signals may be sent to and received from the antenna.

In FIG. 1, the conductive layer 12 is located on the outer surface of the dielectric block 15—no dielectric material is present on the outer side of the conductive layer 12. In contrast, FIG. 2 shows an embedded antenna 110 comprising a resonant structure which may be the same or similar to the resonant structure of the antenna 10 and so like numerals are used to indicate like parts. The conductive layer 112 and the slot 114 are embedded in a non-conductive or dielectric material 115 which, advantageously exhibits a high magnetic permeability.

Embedding the antenna improves the symmetry of the near-field of the antenna and so improves the performance of the antenna. Further, the embedding material 115 reduces the effective length of the resonating structure or resonator with the result that, for given operating frequency band(s), the antenna may be smaller than if it were not embedded. In the particular example of FIG. 2, where the antenna 110 is a folded slot-loop type of antenna, by embedding the peripheral slot 114 in dielectric material, the near-field is more symmetrical around the length of the slot 114 than in the case where the conductive layer 112 is located only on the outer sides of a dielectric block (see FIG. 1). In the latter case, dielectric material is only present on one side of the slot 14 at any point along the slot length, whereas in the embedded case (FIG. 2) the slot-line is loaded on both sides, resulting in a more symmetrical field distribution (when viewed in a cross-sectional plane perpendicular to the slot line 14). Since there is more dielectric material 115 adjacent to the slot-line 114 (i.e. on all sides), the effective dielectric constant of the volume of space that surrounds the slot-line 114 is greater and the required length of the resonator is decreased compared with the asymmetric slot-line case of FIG. 1. In addition, near-field discontinuities which can arise at the junctions of mutually perpendicular sections of the slot-line 14, 114 (e.g. at the interface between horizontal and vertical sections of slot-line 14, 114 as viewed in FIGS. 1 and 2), are reduced since the slot 114 is embedded in dielectric.

In preferred embodiments, the depth to which the antenna 110 is embedded is substantially uniform around the outer surfaces of the antenna 110. By way of example, the depth (e.g. measured from the surface of the embedding material of the embedding material to the surface of the conductive layer 112) may be at least approximately 50% of the thickness of the conductive layer 112 itself, when measured in the same direction, especially where the resonating structure comprises a slot-line or slot loop resonator. More generally, the depth or thickness of the embedding material is preferably such that, during use, it encloses or contains substantially all of the electromagnetic near-fields generated by the resonating structure.

Conveniently, the embedding material may be shaped to suit the required application. In the illustrated embodiment, the embedding material 115, and therefore the antenna 110 as a whole, is substantially cuboid in shape.

In typical applications, the embedded antenna may be mounted on a surface or substrate such as a PCB (Printed Circuit Board). The dielectric or embedding material located between the underside of the embedded antenna and the PCB reduces the detuning of the antenna due to near-field interaction. In the particular example of the antenna 110, the embedding dielectric material concentrates the near-fields close to the slot 114 and away from the surface of the surrounding dielectric block. The result is that the antenna pass band and radiation performance are more immune to variation due to circuit board proximity.

With some manufacturing processes, it can be difficult or inefficient to create a resonant structure, such as the one shown in FIGS. 1 and 2, in which portions of the conductive layer 12, 112 are non-parallel or perpendicular. This problem applies particularly when the resonant structure is embedded. Accordingly, in preferred embodiments, at least one portion of the resonant structure of the antenna, especially where the antenna is embedded, is formed from one or more electrically conductive connector or via. Typically, a plurality of discrete, spaced-apart connectors are used to provide a portion of the resonant structure. In particularly preferred embodiments, the, or each, connector takes the form of a via. A via is a connector or contact for creating an electrical connection between, typically two, but possibly more, layers of a multi-layer structure or substrate. Commonly, a via comprises an aperture or channel formed, e.g. by drilling, through one or more layers of a substrate, the aperture being filled, plated or coated with an electrically conductive material (usually a metal, e.g. copper) to provide a conductive pathway between layers for the purposes of layer-to-layer interconnection.

Figure 4:
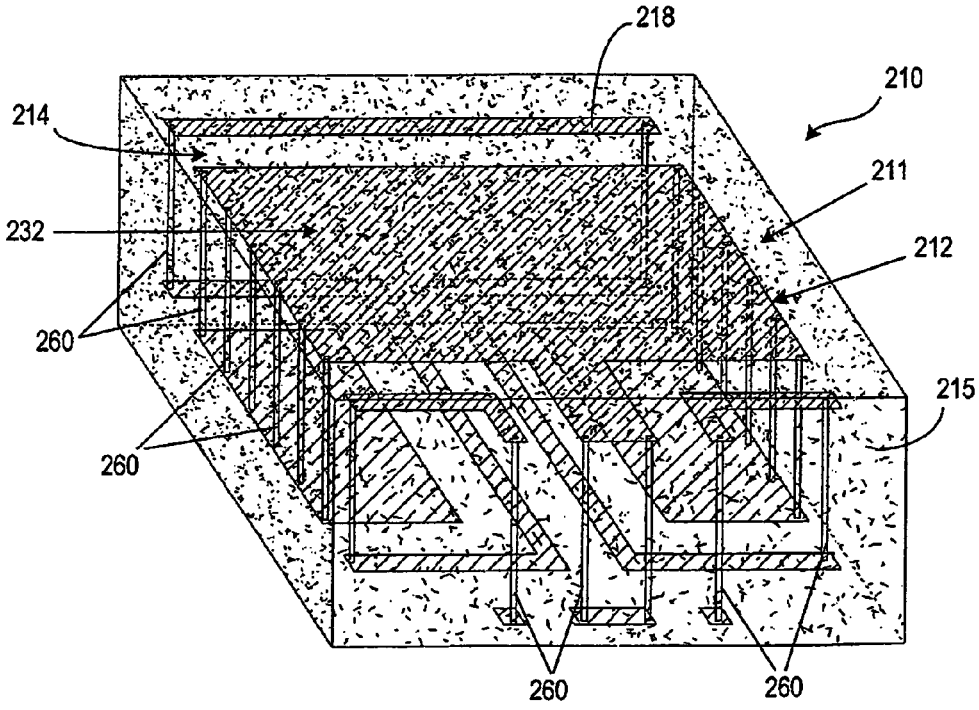
FIG. 4 shows, in perspective view, the antenna of FIG. 3 embedded in non-conductive or dielectric material.

FIG. 3 shows the resonant structure, generally indicated as 211, of an antenna 210 (FIG. 4) in which portions of the resonant structure are formed from electrical connectors, and in particular vias. The resonant structure 211 of FIG. 3 is that of a folded slot-loop antenna which may be the same or similar to the resonant structures of the antennas 10, 110 and so like numerals are used to indicate like parts and similar descriptions apply, as will be apparent to a skilled person. FIG. 4 shows the resonant structure of FIG. 3 embedded in embedding material 215, as described for the embedded antenna 110.

The resonant structure 211 includes a central portion 232 formed as a layer or lamina of metal or other conductive material and two end portions 234, 236 also formed as a layer or lamina of metal or other conductive material. Similarly, ground plane portions 218 are formed as strips or patches of metal or other conductive material. Unlike the structures of FIGS. 1 and 2, the central portion 232 and end portions 234, 236 are not formed from a common, folded conductive layer—each portion 232, 234, 236 comprises a separate lamina or piece of conductive material. It will be seen that the slot portions 224, 226 formed between the central portion 232 and the ground plane 218 are open ended and, in the case of slot portion 224 extends from side-to-side across the resonant structure 211. In the case of the slot portion 226, it may also be said to extend from side-to-side across the resonant structure 211, but interrupted by the feed portion 220. Similarly, the respective slot portions 228, 230 formed between the end portions 234, 236 and the ground plane 218 are open ended as shown.

Instead of the conductive strips used in the structures of FIGS. 1 and 2, the central portion 232 is connected to the end portions 234, 236 by means of a plurality of discrete electrical conductors in the preferred form of conductive vias 260. The parallel ground plane portions 218 are similarly connected. Each via 260 comprises a length of electrically conductive material, typically metal, and is usually formed in the manner described above. The vias 260 are typically substantially cylindrical in shape but do not necessary need to be so.

When implementing a portion of the resonant structure using vias 260 it is preferred to use at least two vias 260, one at or adjacent either end of the portion being implemented. It is more preferable to provide, if space allows, one or more additional vias 260 between said at least two vias 260. The vias 260 are typically spaced-apart although they may be contiguous. One option is to provided as many vias 260 as the manufacturing technology allows. In respect of each portion being implement by vias 260, the vias 260 are preferably arranged in a row, each via 260 in the row being orientated in substantially the same manner. Hence, the vias 260 in a row are preferably substantially parallel with on another. For example, to implement the portion of the resonant structure 211 between the central portion 232 and the end portion 234, respective vias 260A, 260B are located at or adjacent the ends of the portion (and therefore also at the ends of the central and end portions 232, 234) and, preferably, a plurality of additional vias 260 are arranged to form a row therebetween. The row of vias 260 lies in the plane of the portion being implemented, for example in a plane that is substantially perpendicularly with the planes of the central and end portions 232, 234. Alternatively, only vias 260A, 260B, 260C and 260D could be used to implement the vertical (as illustrated) portion (s) of the structure 211, i.e. no additional vias 260 between vias 260A and 260B.

Slots in the resonant structure may be implemented by an appropriately dimensioned space or gap between adjacent vias 260. For example, in the resonant structure 211 where there is a folded slot 214, the portions of the slot to be present on the portion of the structure implemented by vias 260 is implemented by two appropriately spaced and positioned vias 260 (see for example the vias 260C and 260B in FIG. 3 which implement the slot portion between slot portions 226 and 228). In general, in the case of folded slots, a respective via 260 is substantially aligned with an edge of the slot portion formed in the or each adjacent conductive layer or lamina.

In an alternative embodiment (not illustrated), a plurality of spaced apart or contiguous vias are provided between corresponding portions 218 of the ground plane.

The implementation of portions of the resonant structure using vias, or other connectors, is particularly suitable when the antenna is manufactured using multi-layer substrate technology, such as LTCC (Low Temperature Co-fired Ceramic) technology wherein the embedding material 215 comprises LTCC. With such technology, the embedding or dielectric material comprises multiple layers. Those portions of the resonating structure that are formed as or from a conductive lamina or layer (sometimes referred to as active conductive portions) may be formed in conventional manner by depositing, or otherwise providing, a layer of conductive material between adjacent layers of embedding material. Hence, such portions are substantially parallely disposed with the substrate layers. The other portions of the resonating structure may be formed using conductive vias that pass through the substrate layers (usually substantially perpendicularly with the substrate layers). Normally, the vias connect one conductive layer with another conductive layer (as shown in FIGS. 3 and 4). In alternative embodiments, however, the vias may be used to implement any portion(s) of the resonant structure that are non-parallel with the substrate layer(s), irrespective of whether or not said portion(s) connect two or more other portions.

For embodiments where the resonant structure comprises a slot, the higher the dielectric constant and/or electromagnetic permeability, the shorter the total physical, or actual, slot length for a given operating frequency band.

It is preferred that the vias are solid rather than hollow, since solid vias create a lower impedance connection between the component parts of the resonant structure that they connect. It is further preferred to make the vias as thick as the fabrication technology will allow in order to minimize inductance.

The invention is not limited to use with resonant structures of the folded slot-loop type illustrated herein. The invention is particularly suited for use with antennas having a resonant structure with respective portions being disposed in non-parallel planes, especially, but not exclusively, where one or more of said portions includes at least one slot. For example, in an alternative embodiment, the resonant structure may comprise a patch or microstrip resonator, typically located in a spaced apart relationship with a ground plane. Moreover, the principles and techniques described herein can be applied to other, predominantly symmetrical, planar antenna structures where the field modes are understood.

The invention is not limited to the embodiments described herein which may be modified or varied without departing from the scope of the invention.

The invention claimed is:

1. An antenna comprising a resonant structure having a first portion disposed in a first plane, and respective second portions provided at first and second opposite edges of said first portion, each second portion being disposed in a plane non-parallel with said first plane, a third portion being spaced apart from, and substantially parallel with, said first portion, said respective second portions extending between and electrically connecting said respective first and second edges of said first portion with a respective first and second edge of said third portion, wherein the resonant structure is embedded in a non-conductive material, and said respective second portions are substantially planar in shape and are comprised of a plurality of electrically conductive vias arranged in a row and embedded in said non-conductive material, and wherein said first portion comprises a lamina of electrically conductive material and is shaped to define at least one slot, said at least one slot being open-ended at an interface between the first portion and at least one of said respective second portions, from which interface said at least one of said second portions extends to said third portion, wherein said at least one of said respective second portions includes a respective one of said electrically conductive vias aligned with a respective edge of said at least one slot, said respective vias defining a gap therebetween that is aligned with the open end of said at least one slot in said first portion, and wherein said third portion comprises at least one lamina of electrically conductive material and is shaped to define at least one slot, said at least one slot in said third portion being open-ended at an interface between said third portion and said at least one of said respective second portions, from which interface said at least one of said second portions extends to said first portion, wherein said respective vias that are aligned with said respective edge of said at least one slot in said first portion are also aligned with a respective edge of said at least one slot formed in said third portion to define a continuous folded slot that has a first section formed in said lamina of said first portion, a second section defined by said gap between said respective vias and a third section formed in said at least one lamina of said third portion.

2. An antenna as claimed in claim 1, wherein said second portion is substantially perpendicular with said first portion.

3. An antenna as claimed in claim 1, wherein said first portion comprises a layer or lamina of electrically conductive material.

4. An antenna as claimed in claim 3, wherein said first portion is substantially rectangular in shape.

5. An antenna as claimed in claim 4, wherein said third portion comprises a layer or lamina of electrically conductive material.

6. An antenna as claimed in claim 1, wherein at least some of said vias are mutually spaced-apart.

7. An antenna as claimed in claim 1, wherein at least some of said vias are contiguous with one another.

8. An antenna as claimed in claim 1, wherein said resonant structure is embedded in layers of embedding material, said first plane being substantially parallel with said layers and wherein said vias pass through at least one layer of embedding material.

9. An antenna as claimed in claim 8, wherein said embedding material comprises a multi-layer substrate of non-conductive material.

10. An antenna as claimed in claim 1, wherein said embedding material comprises a dielectric material.

11. An antenna as claimed in claim 1, wherein said embedding material exhibits a high magnetic permeability.

12. An antenna as claimed in claim 1, wherein said gap is substantially the same width as said at least one slot.

13. An antenna as claimed in claim 1, wherein a respective aperture is formed in said non-conductive material for each of said plurality of electrically conductive vias, each of said electrically conductive vias comprising a respective quantity of electrically conductive material located in the respective aperture.

14. An antenna as claimed in claim 13, wherein said respective quantity of electrically conductive material substantially fills said respective aperture.

15. An antenna as claimed in claim 13, wherein said respective quantity of electrically conductive material lines said respective aperture.

16. An antenna as claimed in claim 13, wherein said respective quantity of electrically conductive material plates said respective aperture.

* * * * *